US005219166A

United States Patent [19]

Chang

[11] Patent Number: 5,219,166

[45] Date of Patent: * Jun. 15, 1993

[54] METAL RACKET

[76] Inventor: Chen-chung Chang, No. 912, Chung-Shan Rd., Shen-Kang Hsiang, Taichung Hsien, Taiwan

[ * ] Notice: The portion of the term of this patent subsequent to Dec. 22, 2009 has been disclaimed.

[21] Appl. No.: 832,166

[22] Filed: Feb. 6, 1992

[51] Int. Cl.[5] ..... A63B 49/12

[52] U.S. Cl. ..... 273/73 H; 273/73 G

[58] Field of Search ..... 273/73 R, 73 C, 73 D, 273/73 F, 73 G, 73 H

[56] References Cited

U.S. PATENT DOCUMENTS

| | | | |
|---|---|---|---|
| 4,166,616 | 9/1979 | Kohzu | 273/73 G |
| 4,278,251 | 7/1981 | Lafourcade | 273/73 H X |
| 4,282,642 | 8/1981 | Rodgers, Jr. | 273/73 H X |
| 4,290,604 | 9/1981 | Held | 273/73 G |
| 4,331,331 | 5/1982 | Rodgers, Jr. | 273/73 G X |

FOREIGN PATENT DOCUMENTS

| | | | |
|---|---|---|---|
| 2026327 | 2/1980 | United Kingdom | 273/73 G |
| 2028665 | 3/1980 | United Kingdom | 273/73 G |
| 2033760 | 5/1980 | United Kingdom | 273/73 G |
| 2037168 | 7/1980 | United Kingdom | 273/73 G |

*Primary Examiner*—V. Millin
*Assistant Examiner*—Raleigh W. Chiu
*Attorney, Agent, or Firm*—Lowe, Price, LeBlanc & Becker

[57] ABSTRACT

A metal racket has a frame which includes a curved hollow tube with two converging lower joint end portions and a pair of first partition plates provided in each of the lower joint end portions. Each of the pairs of first partition plates confines a first central space and a pair of first side spaces. A shaft includes a hollow tube with an upper joint end portion and a pair of second partition plates provided in the upper joint end portion. The second partition plates confines a second central space and a pair of second side spaces. Each of the first and second side spaces is filled with a vibration absorbing member. A Y-shaped throat member interconnects the lower and upper joint end portions and includes a pair of upper arms and a lower arm. Each of the upper arms has an insert end portion fitted in the first central space at one of the lower joint end portions. The lower arm has an insert end portion fitted in the second central space. A wrapping layer integrally covers the frame, the shaft and the throat member.

8 Claims, 7 Drawing Sheets

METAL RACKET

BACKGROUND OF THE INVENTION

1. Field of the Invention

This invention relates to a racket, more particularly to an improved metal racket which has provisions to reduce vibration of the shaft thereof.

2. Description of the Related Art

When a racket, such as a squash or tennis racket, is struck by a ball, the resulting impact is transmitted from the racket frame through the shaft to the user's hand. Thus, injury to the user's wrist or elbow may result if the impact is relatively strong or frequent.

There are some improved conventional rackets which are made for absorbing vibration and damping the impact transmitted to the user's hand. These improved conventional rackets cannot absorb vibration completely. Some impact is still transmitted to the user's hand. As a result, the user can still be injured.

SUMMARY OF THE INVENTION

Therefore, the objective of this invention is to provide an improved metal racket which has provisions to eliminate completely vibration of the shaft thereof so a user can comfortably hold and use the racket without danger of injury.

Accordingly, a metal racket of this invention includes a frame, a shaft and a Y-shaped throat member. The frame includes a curved hollow tube with two downwardly extending and converging lower joint end portions and a pair of spaced first partition plates longitudinally provided in each of the lower joint end portions. Each of the pairs of the first partition plates confines a first central space therebetween and defines a pair of first side spaces on two sides of the first central space. Each of the first side spaces is filled with a vibration absorbing member.

The shaft includes a hollow tube with an upper joint end portion and a pair of spaced second partition plates longitudinally provided in the upper joint end portion. The second partition plates confines a second central space therebetween and defines a pair of second side spaces on two sides of the second central space. Each of the second side spaces is filled with a vibration absorbing member.

The Y-shaped throat member interconnects the lower joint end portions of the frame and the upper joint end portion of the shaft. The throat member includes a pair of diverging upper arms and a lower arm. Each of the upper arms has an insert end portion fitted in the first central space of one of the lower joint end portions. The lower arm has an insert end portion fitted in the second central space of the upper joint end portion.

A wrapping layer integrally covers the frame, the shaft and the throat member.

BRIEF DESCRIPTION OF THE DRAWING

Other features and advantages of the present invention will become apparent in the following detailed description of the preferred embodiments, with reference to the accompanying drawings, of which.

DETAILED DESCRIPTION OF THE PREFERRED EMBODIMENTS

Figure 1:
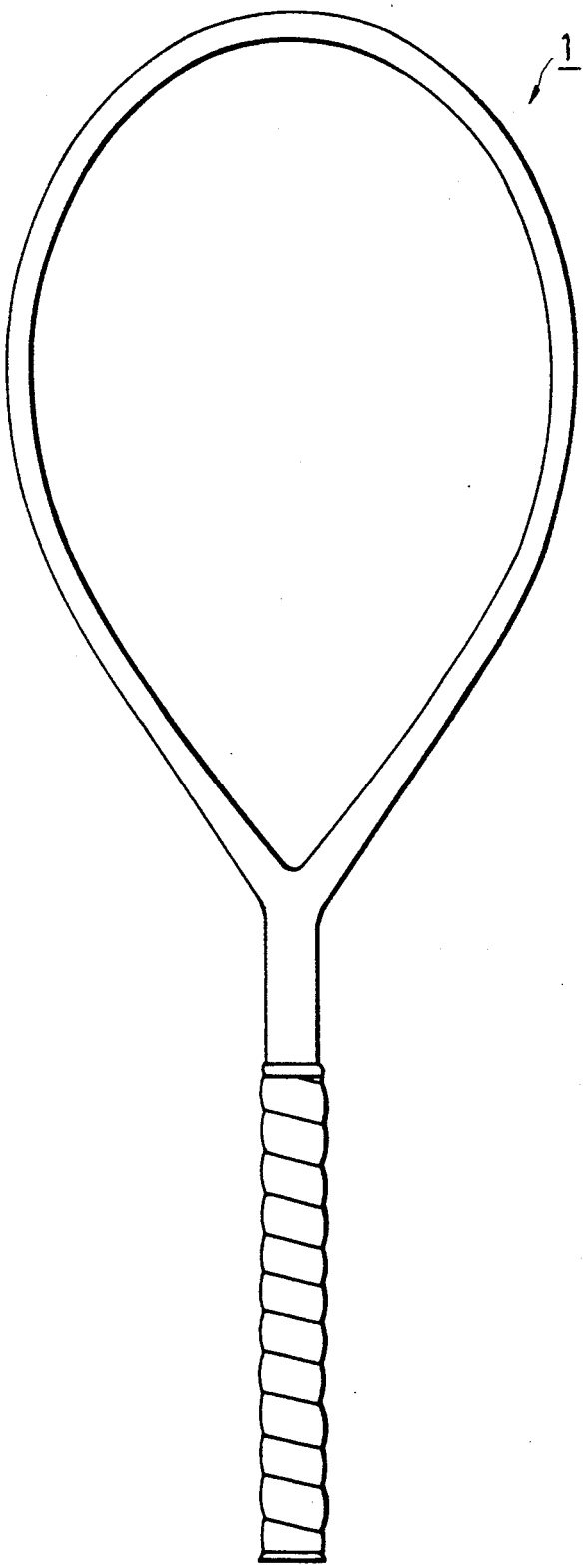
FIG. 1 is a schematic view of a metal racket of this invention.
Figure 2:
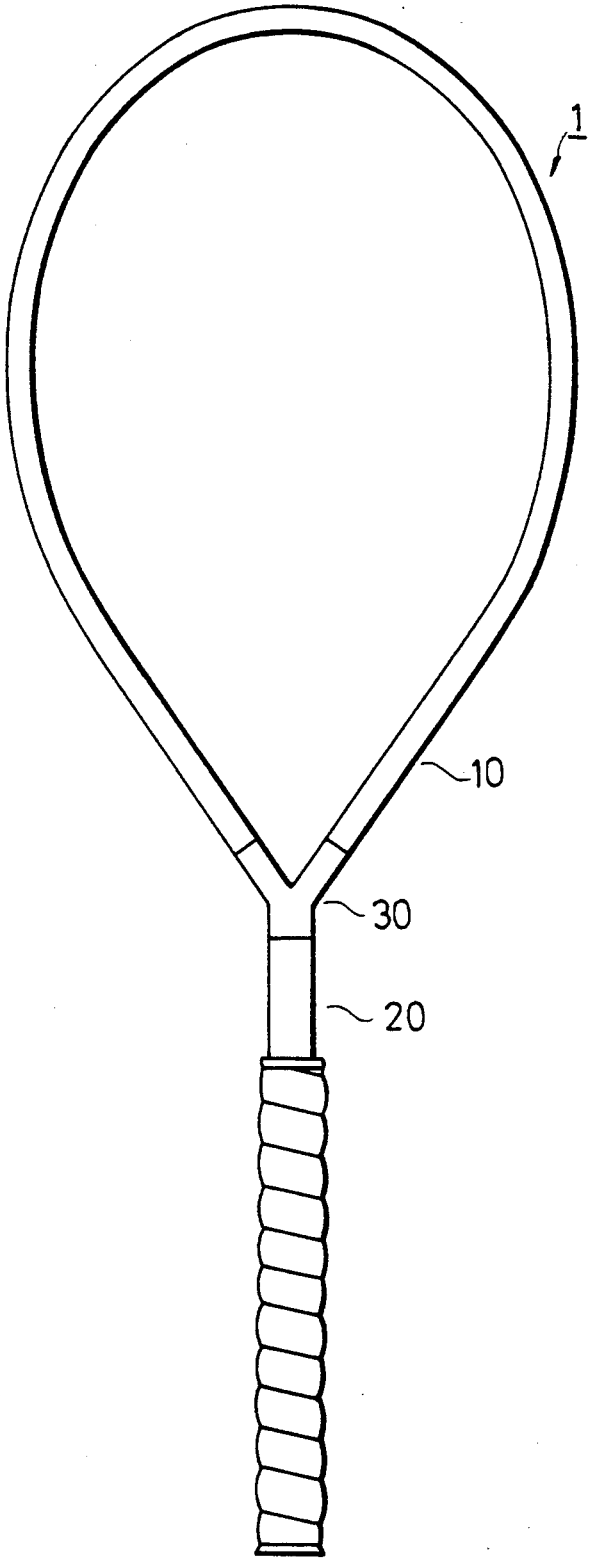
FIG. 2 is a schematic view of the metal racket of this invention without a wrapping layer.
Figure 3:
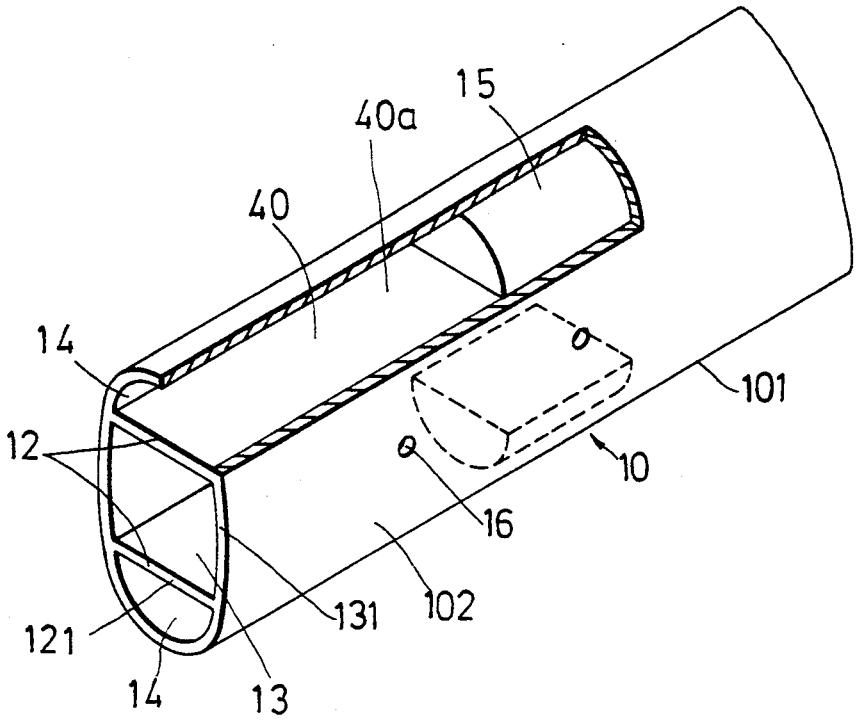
FIG. 3 is a partial sectional view of the frame of the metal racket of this invention.
Figure 4:
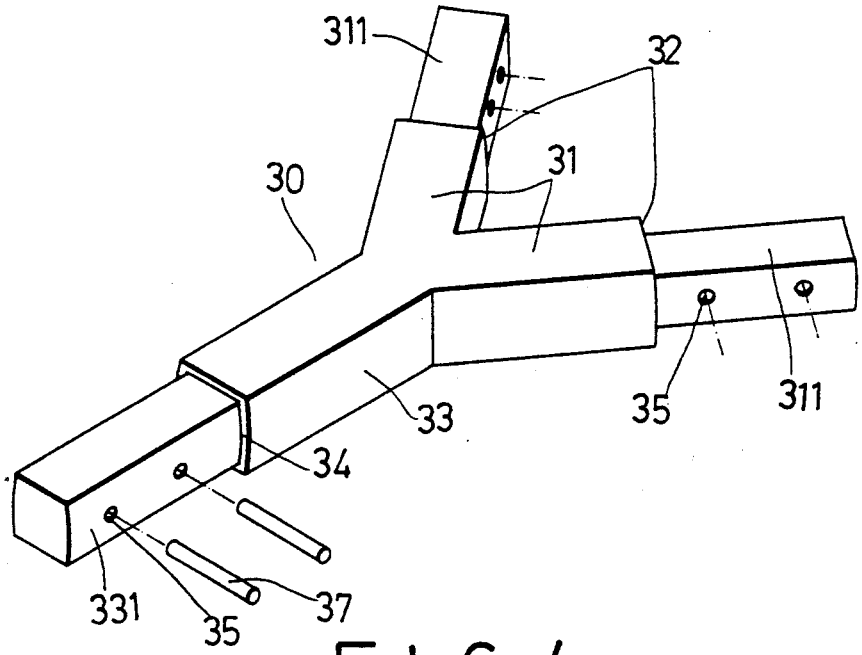
FIG. 4 is a schematic view of the throat member of the metal racket of this invention.
Figure 5:
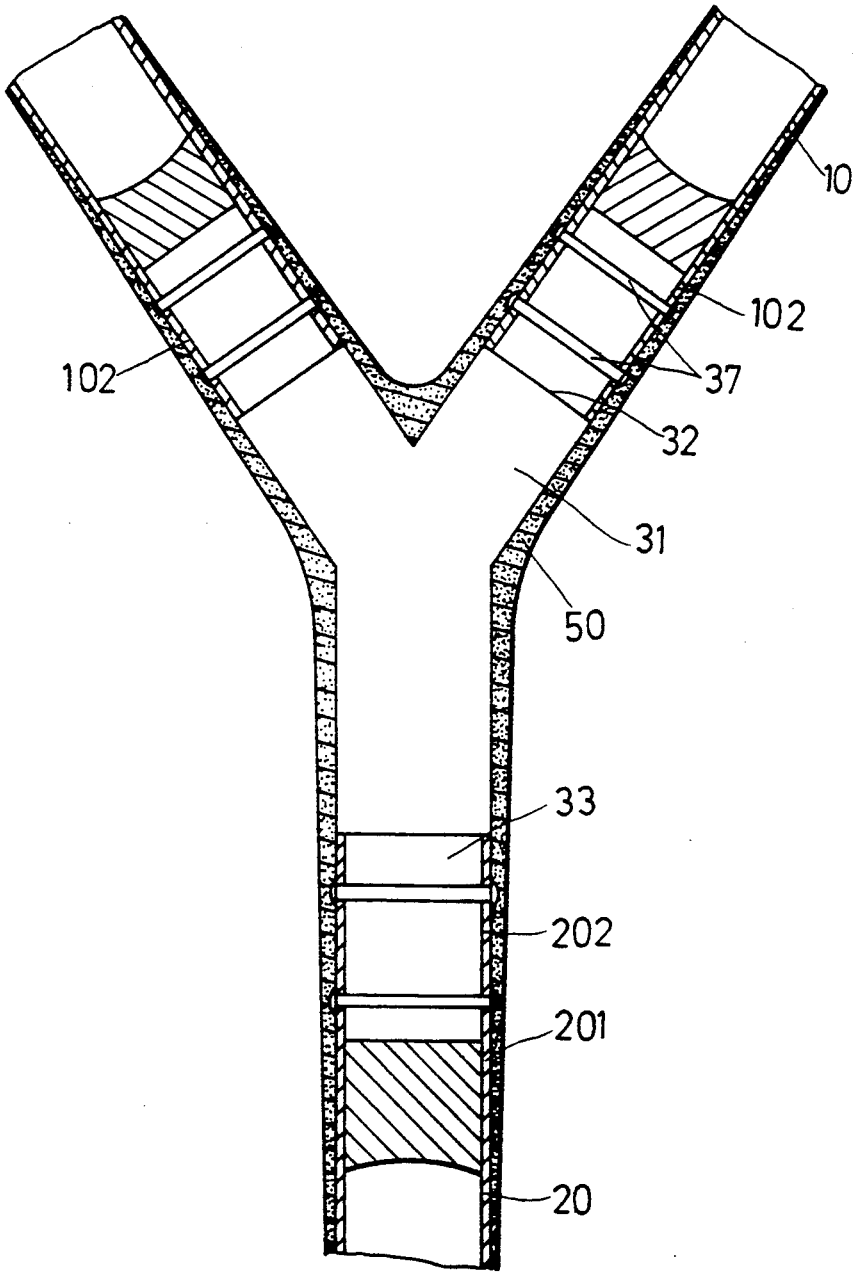
FIGS. 5 and 6 are partial sectional views showing the interconnection of the throat member between the frame and the shaft.
Figure 6:
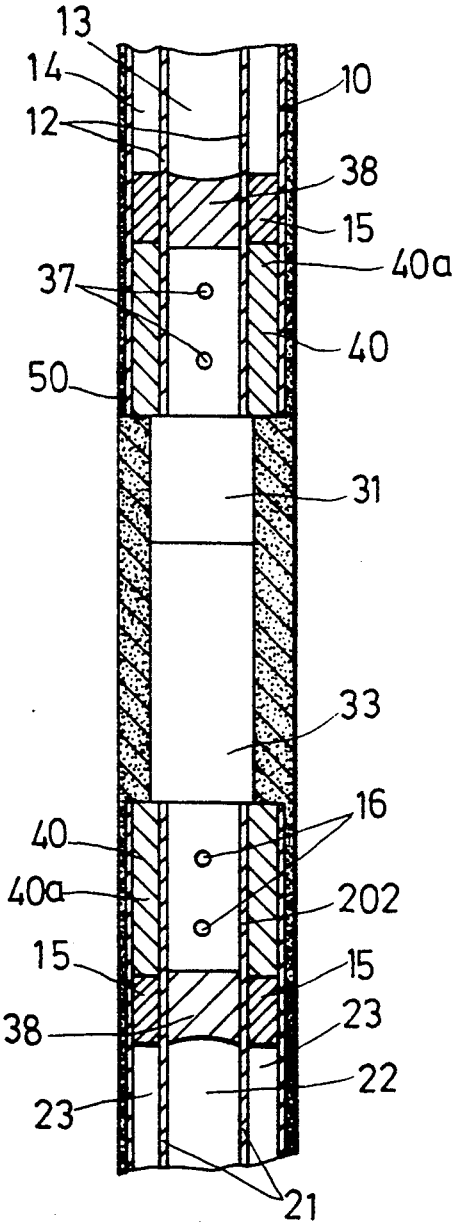

Referring to FIGS. 1 and 2, a metal racket (1) of this invention includes a frame (10), a shaft (20) and a Y-shaped throat member (30). The frame (10), the shaft (20) and the throat member (30) are made of aluminum. Referring to FIGS. 3 to 6, the frame (10) includes a curved hollow tube (101) having an ovalshaped cross-section and two downwardly extending and converging lower joint end portions (102). A pair of spaced first partition plates (12) is provided in the curved hollow tube (101) and extends along the length of the curved hollow tube (101). The pair of the first partition plates (12) confines a first central space (13) therebetween and defines a pair of first side spaces (14) on two sides of the first central space (13). Each of the first side spaces (14) is filled with a vibration absorbing member (40*a*) at each of the lower joint end portions (102).

The shaft (20) includes a hollow tube (201) with an upper joint end portion (202) and a pair of spaced second partition plates (21) provided in the hollow tube (201) and extending along the length of the hollow tube (201). The pair of second partition plates (21) confines a second central space (22) therebetween and defines a pair of second side spaces (23) on two sides of the second central space (21). Each of the second side spaces (23) is filled with a vibration absorbing member (40*a*) at the upper joint end portion (202). [Like elements are indicated by the same reference numerals through out the disclosure].

Each of the vibration absorbing members (40*a*) includes an in situ formed plastic member (40) and an insert piece (15) which is provided inwardly of the in situ formed plastic member (40) and prior to the formation of the in situ formed plastic member (40). The in situ formed plastic member (40) can be a composite or non-composite plastic material. The insert piece (15) may be a cork or a molded plastic material.

The Y-shaped throat member (30) interconnects the lower joint end portions (102) of the frame (10) and the upper joint end portion (202) of the shaft (20). The throat member (30) includes a pair of diverging upper arms (31) and a lower arm (33). Each of the upper arms (31) has an insert end portion (311) fitted in the first central space (13) at one of the lower joint end portions (202). The lower arm (33) has an insert end portion (331) fitted in the second central space (22) at the upper joint end portion (202). Each of the upper and lower arms (31, 33) has a reduced cross-section at the insert end portion (311, 331) thereof and a shoulder (32, 34) formed inwardly of the insert end portion (31, 33). Each of the shoulders (32) abuts the edge faces (121) of the first partition plates (12) and the edge faces (131) of the curved hollow tube (101) when the insert end portions (311) are fitted in the first space (13). Similarly, the shoulder (34) also abuts the edge faces of the second partition plates (21) and the hollow tube (201).

Each of the lower joint end portions (102) of the curved hollow tube (101) has two pairs of locking holes (16) formed thereon. The upper joint end portions (202) of the hollow tube (201) has two pairs of locking holes (16) formed thereon. Each of the insert end portions (311, 331) has a pair of through holes (35) formed thereon to be aligned with a respective one of the pairs of locking holes (16) when the insert end portions (311, 331) are respectively fitted in the first and second central spaces (13, 22). Pins (37) are provided to pass through the locking holes (16) and the through holes (35) for securing the insert end portions (311, 331) in the first and second central spaces (13, 22). Furthermore, an adhesive glue (38) can be provided in and cured in each of the first and second central spaces (13, 22) adjacent to each insert end portion (311 or 331) in order to adhere the insert end portions (311, 331) in the lower and upper joint end portions (102, 202) so as to enhance the positioning of the insert end portions (311, 331) in the first and second central spaces (13, 32).

A wrapping layer (50) integrally covers the frame (10), the shaft (20) and the throat member (30). The wrapping layer (50) is made of a plastic material such as a fiber-reinforced composite plastic material.

The in situ formed plastic members (40) can be formed by introducing a plastic material into the first and second side spaces (14, 23) through the open ends of the lower and upper joint end portions (102, 202) after the insertion of the insert pieces (15) and prior to the insertion of the insert end portions (311, 331). The frame (10), which has been connected to the shaft (20) by the throat member (30) as described above, is placed in a die (not shown) and a plastic material is extruded into the die so as to form the wrapping layer (50) which covers the frame (10), the shaft (20) and the throat member (30).

Figure 8:
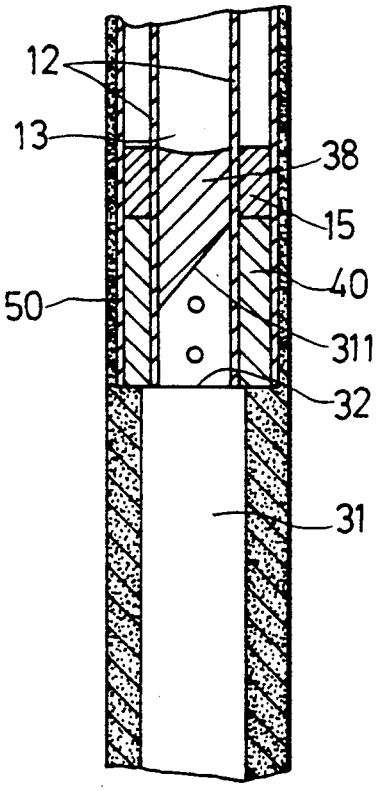
FIG. 8 is a sectional view showing that the insert end portion of the throat member in FIG. 7 is fitted in the joint end portion of the frame.
Figure 7:
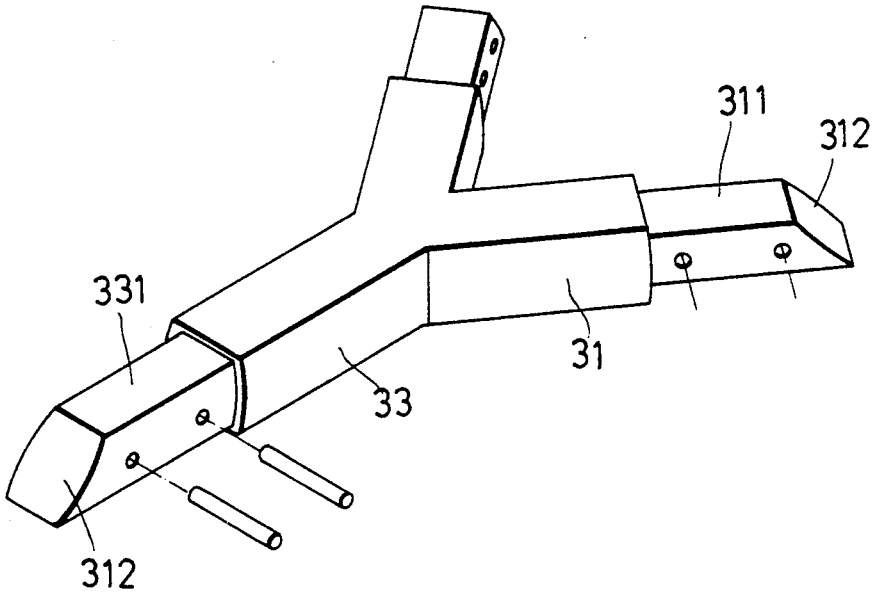
FIG. 7 is a schematic view of the throat member, the insert end portions of which are formed with wedge-shaped distal ends.

Referring to FIGS. 7 and 8, each of the insert end portions (311, 331) may have a wedge-shaped distal end (312) in order to enhance the bonding between the insert end portion (311 or 331) and the adhesive glue (38).

Figure 9:
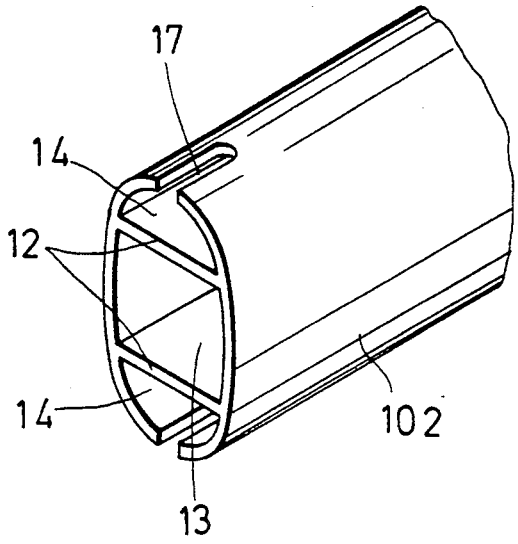
FIGS. 9 and 10 provide end and cross sectional views of lower and upper joint end portions of the frame.
Figure 10:
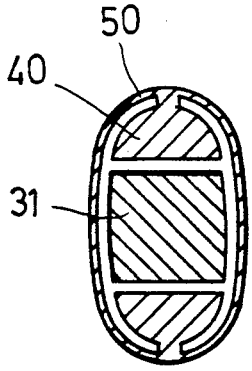

Referring to FIGS. 9 and 10, each of the lower joint end portions (102) may have a pair of slots (17) formed thereon which respectively access the first side spaces (14). The upper joint end portion (202) also may have a pair of slots (not shown) formed thereon which access the second side spaces (23). In this case, the material, which is introduced into the die to form the wrapping layer (50), can flow into the first and second side spaces (14, 23) through the slots to form the in situ formed plastic members (40). The insert pieces (15) are respectively provided in the first and second side spaces (14, 23) prior to forming the in situ formed plastic members (40) and the wrapping layer (50). The insert end portions (311, 331) are also respectively fitted in the first and second central spaces (13, 22) prior to the formation of the in situ formed plastic members (40) and the wrapping layer (50).

Thus, when the metal racket (1) is struck by a ball, the vibration transmitted from the frame (10) to the shaft (20) is absorbed and eliminated completely by the vibration absorbing members (40a) which are provided in the frame (10) and the shaft (20).

While the present invention has been described in connection with what is considered the most practical and preferred embodiment, it is understood that this invention is not limited to the disclosed embodiments but is intended to cover various arrangements included within the spirit and scope of the broadest interpretations and equivalent arrangements.

I claim:

1. A metal racket comprising:

a frame including a curved hollow tube with two downwardly extending and converging lower joint end portions and a pair of spaced first partition plates longitudinally provided in each of said lower joint end portions, each of said pairs of said first partition plates confining a first central space therebetween and defining a pair of first side spaces on two sides of said first central space, each of said first side spaces being filled with a vibration absorbing member;

a shaft including a hollow tube with an upper joint end portion and a pair of spaced second partition plates longitudinally provided in said upper joint end portion, said second partition plates confining a second central space therebetween and defining a pair of second side spaces on two sides of said second central space, each of said second side spaces being filled with a vibration absorbing member;

a Y-shaped throat member interconnecting said lower joint end portions of said frame and said upper joint end portion of said shaft, said throat member including a pair of diverging upper arms and a lower arm, each of said upper arms having an insert end portion fitted in said first central space of one of said lower joint end portions, said lower arm having an insert end portion fitted in said second central space of said upper joint end portion; and a wrapping layer integrally covering said frame, said shaft and said throat member.

2. A metal racket as claimed in claim 1, wherein each of said upper and lower arms has a reduced cross-section at said inserted end portion thereof and a shoulder formed inwardly of said insert end portion.

3. A metal racket as claimed in claim 2, wherein each of said insert end portions of said upper and lower arms has a wedge-shaped distal end.

4. A metal racket as claimed in claim 1, wherein each of said insert end portions of said upper and said lower arms has a wedge-shaped distal end.

5. A metal racket as claimed in claim 1, wherein each of said vibration absorbing members includes an in situ formed plastic member and an insert piece provided in each of said first and second side spaces inwardly of said in situ formed plastic member and prior to the formation of said in situ formed plastic member.

6. A metal racket as claimed in claim 5, wherein said insert piece is made of a plastic material.

7. A metal racket as claimed in claim 5, wherein said insert piece is a cork.

8. A metal racket as claimed in claim 1, wherein said wrapping layer is made of a plastic material.

* * * * *